US007172992B2

(12) United States Patent
Kidnie et al.

(10) Patent No.: US 7,172,992 B2
(45) **Date of Patent: *Feb. 6, 2007**

(54) BIGUANIDE BLEACHING AGENT FOR A THERMAL-IMAGING RECEPTOR ELEMENT

(75) Inventors: Kevin M. Kidnie, St. Paul, MN (US); Richard R. Ollmann, Woodbury, MN (US); Pao Vang, Brooklyn Park, MN (US)

(73) Assignee: Eastman Kodak Company, Rochester, NY (US)

( * ) Notice: Subject to any disclaimer, the term of this patent is extended or adjusted under 35 U.S.C. 154(b) by 24 days.

This patent is subject to a terminal disclaimer.

(21) Appl. No.: 10/949,899

(22) Filed: Sep. 24, 2004

(65) Prior Publication Data

US 2005/0181943 A1 Aug. 18, 2005

Related U.S. Application Data

(60) Provisional application No. 60/506,475, filed on Sep. 26, 2003.

(51) Int. Cl.
*B41M 5/38* (2006.01)

(52) U.S. Cl. ..... 503/227; 156/235; 427/146; 428/32.39; 428/32.6; 428/32.81; 428/195.1

(58) Field of Classification Search .. 428/32.39–39.52; 503/227

See application file for complete search history.

(56) References Cited

U.S. PATENT DOCUMENTS

| | | | |
|---|---|---|---|
| 3,960,949 A | 6/1976 | Ahrens et al. | |
| 3,996,232 A | 12/1976 | Diamond et al. | |
| 4,876,235 A | 10/1989 | DeBoer | |
| 4,891,423 A | 1/1990 | Stockel | |
| 5,017,547 A | 5/1991 | DeBoer | |
| 5,126,760 A | 6/1992 | DeBoer | |
| 5,171,650 A | 12/1992 | Ellis et al. | |
| 5,219,703 A | 6/1993 | Bugner et al. | |
| 5,380,644 A | 1/1995 | Yonkoski et al. | |
| 5,843,617 A | 12/1998 | Patel et al. | |
| 5,935,758 A | 8/1999 | Patel et al. | |
| 5,945,249 A | 8/1999 | Patel et al. | |
| 6,171,766 B1 | 1/2001 | Patel et al. | |
| 6,291,143 B1 | 9/2001 | Patel et al. | |
| 6,855,474 B1 * | 2/2005 | Kidnie et al. | 430/200 |
| 6,899,988 B2 * | 5/2005 | Kidnie et al. | 430/200 |

FOREIGN PATENT DOCUMENTS

| | | |
|---|---|---|
| EP | 0 157 568 | 6/1990 |
| EP | 0 739 748 | 10/1996 |
| EP | 0 602 893 | 8/1997 |
| EP | 0 675 003 | 9/1997 |
| GB | 2 083 726 | 3/1982 |
| WO | WO 90/12342 | 10/1990 |
| WO | WO 94/04368 | 3/1994 |
| WO | WO 98/07575 | 2/1998 |
| WO | WO 00/37258 | 6/2000 |
| WO | WO 03/033606 | 4/2003 |

OTHER PUBLICATIONS

M. Tanzer, A. M. Slee, and B. A. Kamay in "Structural Requirements of Guanide, Biguanide, and Bisbiguanide Agents for Antiplaque Activity", *Antimicrob Agents Chemother*. 12, 721 (1977).

* cited by examiner

*Primary Examiner*—Bruce H. Hess
(74) *Attorney, Agent, or Firm*—Lynne M. Blank

(57) ABSTRACT

The present invention provides a receptor element for use in thermal transfer imaging. The receptor element includes a coating having a polymeric binder and a biguanide bleaching agent. The biguanide bleaching agent is capable of bleaching an infrared-absorbing dye when the biguanide bleaching agent and the infrared-absorbing dye are in contact. A particularly suitable biguanide bleaching agent is 1-(o-tolyl)biguanide. The invention also provides compositions and methods for manufacturing a receptor element. Also provided by the invention is an imaging system for thermal transfer imaging. The imaging system includes a color-bearing element and a bleaching element, wherein the bleaching element includes a coating having a polymeric binder and a biguanide bleaching agent. The invention further provides methods useful in the production of integral proofs.

57 Claims, No Drawings

BIGUANIDE BLEACHING AGENT FOR A THERMAL-IMAGING RECEPTOR ELEMENT

REFERENCE TO RELATED APPLICATIONS

This application claims the benefit of U.S. Provisional Application 60/506,475 filed Sep. 26, 2003, the disclosure of which is incorporated by reference in its entirety.

TECHNICAL FIELD

The present invention relates to thermal transfer imaging using an infrared radiation source. In thermal transfer imaging, an image is generally formed by transfer of a colorant (e.g., a dye or pigment) from a donor element to a receptor element under the influence of energy from a thermal printhead or a laser. The donor element, which is generally a sheet having a coating layer containing a transferable colorant, and receptor element are brought into close proximity or into contact with each other. An infrared absorber is present in one or both of the donor element and receptor element. Most commonly, the infrared absorber is present only in the donor element. When the assembly is patternwise exposed to infrared radiation, normally from a scanning infrared laser source, the radiation is absorbed by the infrared absorber, which causes transfer of colorant from the donor element to the receptor element in those imaged areas. This process is outlined in U.S. Pat. No. 5,935,758 to Patel, et al., which is hereby incorporated by reference in its entirety.

The present invention may be utilized, for example, in the production of color proofs. Pre-press or off-press color proofing is used by printers to simulate the images that will be produced by a printing process. Pre-press color proofing systems include overlay proofing systems and integral proofing systems.

In an overlay proof, each printing color is generally segregated onto a separate transparent sheet or film, known as an overlay. The individual overlays are assembled in registration to make the overlay proof, which is viewed as a composite against an appropriate background (e.g., an opaque reflective white sheet), to predict the appearance of a printed image.

In an integral proof, all printing colors are generally shown on one medium. One commonly used method of obtaining an integral proof is by a "surprint" technique. In a surprint technique, the transfer process described above is repeated using different donor elements (generally representing different colors) and the same receptor element. Generally several monochrome images are superimposed in register on a common receptor element, thereby generating a multi-color image in a single-sheet format. A proof made by the surprint technique is also known as an "overprint" proof, and the two terms are used interchangeably herein.

Both overlay proofs and surprint proofs are commonly used as "contract proofs." A contract proof serves as a promise by the printer to a customer that a proofed image will be duplicated by the printing process when press prints are made. Therefore, the printer desires to have proofs that can most accurately predict the image that will be reproduced by the press prints. The need for accurate proofs is especially critical where custom colors are employed in the printing process.

The present invention is suitably employed in a method for producing a surprint proof. The surprint process is ideally suited for processing images using digitally stored information by a thermal transfer imaging procedure. The surprint process has the additional benefits of not requiring chemical processing and of not employing materials that are sensitive to ambient white light. The process is particularly suited to the color proofing industry, where color separation information is routinely generated and stored electronically and the ability to convert such data into hardcopy via digital address of "dry" media is seen as an advantage.

In thermal transfer imaging, the transfer of colorant can occur via mass transfer or dye transfer. In a mass transfer system, the majority of the material on the donor element (e.g., colorant, binder, and additives) is transferred to the receptor element. Typically, this can occur either by a melt mechanism or by an ablative mechanism. In a melt mechanism (or "melt-stick" mechanism), the donor element material is softened or melted. This softened or molten material then flows across to or otherwise adheres to the receptor element. This is typically the mechanism at work in a conventional, thermally induced wax transfer system. In an ablative mechanism, gases are typically generated that explosively propel material from the donor element across to the receptor element. For example, there may be a rapid buildup of pressure as a result of volatilization or decomposition of binders or other ingredients to gaseous products, causing physical propulsion of colorant material from the donor element to the receptor element. Ablation transfer is reported, for example, in U.S. Pat. No. 5,171,650 to Ellis, et al. and in International Publication WO 90/12342.

The image formed from a mass transfer system is typically a halftone image. In a system that forms halftone images, the transfer gives a bi-level image in which either zero or a predetermined density level is transferred in the form of discrete dots (i.e., pixels). These dots can be randomly or regularly spaced per unit area, but are normally too small to be resolved by the naked eye. Thus, the perceived optical density in a halftone image is controlled by the size and the number of discrete dots per unit area. The smaller the fraction of a unit area covered by the dots, the less dense the image will appear to an observer.

In a dye transfer system, only the colorant is transferred from the donor element to the receptor element. That is, the colorant is transferred unaccompanied by the binder or other additives. This can occur either by a diffusion mechanism or a sublimation mechanism. Examples of this process are disclosed, for example, in U.S. Pat. No. 5,126,760 to DeBoer.

Diffusion or sublimation transfer enables the amount of colorant transferred to vary continuously with the input energy. The image formed from a dye transfer system is therefore typically a continuous tone, or "contone," image. In a contone image, the perceived optical density is a function of the quantity of colorant per pixel, higher densities being obtained by transferring greater amounts of colorant.

To emulate halftone images using a dye transfer system, which typically forms a contone image, the imaging laser beam can be modulated by electronic signals which are representative of the shape and color of the original image, so that each dye is heated to cause volatilization only in those areas in which its presence is required on the receptor element to reconstruct the color of the original object. Further details of this process are reported in U.K. patent application GB 2 083 726.

U.S. Pat. Nos. 4,876,235 and 5,017,547 to DeBoer also report a thermal dye transfer system in which the perceived optical density is obtained by controlling the tonal gradation or thickness (density) of the colorant per pixel. In this system, the receptor element includes spacer beads to prevent contact between the donor element and receptor elements. This allows for the dye to diffuse or sublime across to the receptor element without the binder.

For imaging by means of laser-induced transfer, the donor element typically includes a support having a coating comprising (in one or more layers) an absorber for the laser radiation, a transferable colorant (e.g., one or more dyes or pigments), and one or more binder materials. When the donor element is placed in proximity to a suitable receptor element and subjected to a pattern of laser irradiation, absorption of the laser radiation causes rapid build-up of heat within the donor element, sufficient to cause transfer of colorant to the receptor element in irradiated areas.

A problem common to all these imaging methods is that some or all of the infrared absorber can be transferred along with the colorant. If an infrared absorbing dye is transferred to a receptor element during imaging, the dye can visibly interfere with the color produced because it absorbs slightly in the visible region of the spectrum. Unless the infrared absorber is completely colorless, the final image is contaminated and not a true color reproduction, and hence unacceptable for high quality proofing purposes.

Attempts have been made to minimize co-transfer by placing the infrared absorber in a layer separate from the colorant, which may affect the sensitivity, and to find infrared absorbers with minimal visible absorption (see, for example, EP publication 0 157 568). In practice, however, there is nearly always some residual absorption, which has limited the usefulness of the technology. If the infrared absorber is present in the receptor element from the outset, as disclosed in International Publication WO 94/04368 for example, then the problem of contamination and color fidelity is even more acute.

U.S. Pat. No. 5,219,703 to Bugner, et al. reports laser-induced thermal dye transfer using heat-transferable dyes, bleachable and heat-transferable near-infrared absorbing sensitizers, acid photogenerating compounds and optionally near-ultraviolet absorbing sensitizers. The combination of the near-infrared absorbing sensitizer and acid photogenerating compounds effects transfer of the heat transferable dyes and bleaching of the near-infrared absorbing sensitizer to eliminate unwanted visible light absorption. The acid photogenerating compound may be present in either the dye donor element or dye receiver element. If the acid photogenerator is in the dye donor element, bleaching will occur upon initial exposure of the dye donor element to near-infrared or near-ultraviolet radiation. If present in the dye receiver element, bleaching will occur upon subsequent exposure of the dye receiver to near-infrared or near-ultraviolet radiation.

EP publication 0 675 003 discloses the use of thermal bleaching agents in laser thermal transfer imaging, and in particular the use of amines, amine-generating species or carbanion-generating species to bleach cationic dyes such as tetraarylpolymethine dyes and amine cation radical dyes. The bleaching agents are typically located in a resin layer on the surface of the receptor element, or are brought into contact with the image in a separate transfer step subsequent to the laser transfer step(s). The preferred bleaching agents are carbanion-generating species, such as quaternary ammonium salts of arylsulfonylacetic acids.

U.S. Pat. No. 5,843,617 to Patel, et al., U.S. Pat. No. 5,945,249 to Patel, et al., U.S. Pat. No. 6,171,766 to Patel, et al., and U.S. Pat. No. 6,291,143 to Patel, et al. report the use of 1,4-dihydropyridine derivatives as bleaching agents.

In U.S. Pat. No. 5,935,758 to Patel, et al., the use of guanidines as bleaching agents is reported. Guanidines have good stability, solubility, and compatibility with many binders known in the art. They are solids as opposed to liquids, and are rapid-acting. Solid-phase additives are advantageous because they are involatile at room temperature. Guanidines are relatively small molecules which diffuse very effectively into the transferred material when heated. Significantly, they do not discolor during storage, do not precipitate out of water-based systems (e.g., latex systems) prior to coating onto a substrate, and do not crystallize out of the coating.

There is a continuing need to provide alternative bleaching agents for infrared dyes, suitable for use in laser thermal transfer imaging. Suitable bleaching agents do not require exposure to light to become active, but will bleach the relevant infrared dyes at ambient or elevated temperatures.

SUMMARY OF THE INVENTION

In one embodiment, the present invention provides a receptor element for use in thermal transfer imaging. The receptor element includes a sheet support having an image-receiving side, and has a coating on the image-receiving side of the support, the coating including a polymeric binder and a biguanide bleaching agent.

In another embodiment, the invention provides a method for making a receptor element. The method includes the steps of providing a sheet support having an image-receiving side, and applying a coating to the image-receiving side, the coating including a polymeric binder and a biguanide bleaching agent.

The invention further provides a coating composition suitable for manufacturing a receptor element. The coating composition includes a suitable solvent, and the following components dissolved or dispersed in the solvent (where the percentages are based only on the solids content of the composition): a) 40 to 90 wt.-% of a polymeric binder; b) 2 to 25 wt.-% of a biguanide bleaching agent; and c) 0.1 to 35 wt.-% of a particulate material.

Also provided by the invention is an imaging system for thermal transfer imaging. The imaging system includes a color-bearing element comprising a colorant and an infrared-absorbing dye; and a bleaching element comprising a sheet support having an imaging side and a coating on the imaging side, the coating including a polymeric binder and a biguanide bleaching agent. The biguanide bleaching agent is capable of bleaching the infrared-absorbing dye when the biguanide bleaching agent and the infrared-absorbing dye are in contact.

The invention also includes a method for use in the production of an integral proof, such as a surprint proof. The method includes the steps of: a) providing a color-bearing element comprising a transferable colorant and an infrared-absorbing dye; b) providing a bleaching element comprising a sheet support and having a coating on an image-receiving side of the sheet support, the coating including a polymeric binder and a biguanide bleaching agent; c) assembling the color-bearing element and the bleaching element in close proximity, with the image-receiving side of the bleaching element adjacent to the color-bearing element; and d) imagewise transferring colorant from the color-bearing element to the image-receiving side of the bleaching element. In one embodiment, step d) is done by imagewise exposing the assembly of a donor and receptor elements using infrared radiation, to cause imagewise transfer of colorant from the donor element to the receptor element. In another embodiment, several of the steps are repeated using a different donor element, and then the transferred colorant is imagewise transferred from the receptor element to a proof substrate. In yet another embodiment, the receptor element is a proof substrate.

DETAILED DESCRIPTION OF THE INVENTION

As detailed herein, compounds having a biguanide group have been found to be faster and more efficient bleaching agents than guanidines for bleaching interferents such as infrared-absorbing dyes that may be present after a thermal transfer imaging process.

An "interferent" is a compound that undesirably creates a color or color difference that is visible to the human eye. In the practice of the present invention, an infrared-absorbing dye that resides or is transferred with a colorant to a receptor element in a thermal transfer imaging process may be an interferent.

The term "bleaching" means a substantial reduction in a light absorption characteristic that creates a color or color difference visible to the human eye (such as from an interferent), regardless of how the reduction is achieved. For example, there may be an overall reduction in the intensity of an absorption of an interferent, or the absorption may be shifted to non-interfering wavelengths (e.g., wavelengths outside the visible region of the spectrum), or there may be a change in shape of the absorption band, such as, a narrowing, sufficient to render the interferent colorless.

A "bleaching agent" is a compound that can cause bleaching of an interferent, and that is employed for that purpose. In particular, for the practice of the present invention, a bleaching agent is capable of bleaching an infrared-absorbing dye that may be present as an interferent after a thermal transfer imaging process. In particular, the present invention utilizes a bleaching agent that is a compound or polymer having a biguanide group. The compound or polymer may be a biguanide compound, a bis-biguanide compound, or a polymeric biguanide, for example.

The term "thermal bleaching agent" used herein refers to a bleaching agent that does not require exposure to light to become active, but will bleach an interferent at ambient or elevated temperatures.

Receptor Element

In one embodiment, the present invention provides a receptor element for use in thermal transfer imaging. The receptor element includes a sheet support having an image-receiving side, and a coating on the image-receiving side of the support, the coating including a polymeric binder and a biguanide bleaching agent for bleaching an infrared-absorbing dye transferred to the image-receiving side of the receptor element during thermal transfer imaging. In some embodiments, the coating further comprises a particulate material or other texturizing material.

As used herein, the phrase "receptor element" refers to a material, generally in sheet-form, having at least one major surface that is capable of imagewise accepting colorant transferred from a color-bearing element, such as a donor element, in thermal transfer imaging. The image-receiving major surface is generally treated or coated to facilitate the acceptance and fixation of the transferred colorant.

Apart from the presence of the biguanide bleaching agent, the construction of the receptor element of the invention can be conventional. Receptor elements used in thermal transfer imaging typically comprise a support, such as paper or plastic sheet, bearing one or more coatings on an image-receiving side. The coating is typically several micrometers thick, and may comprise a binder capable of providing a tack-free surface at ambient temperatures, and which is compatible with the material that will be transferred from the donor element (such as the colorant).

In an alternative embodiment, the receptor element includes a release layer on the image-receiving side of the sheet support. The release layer generally resides between the sheet support and the image-receiving coating that contains the bleaching agent. A release layer may comprise a suitable binder or mixture of binders, for example, as described below. By way of example, a styrene/butadiene copolymer available under the trade designation PLIOLITE from Goodyear Chemical (Akron, Ohio) may be suitable. The use of a release layer in the receptor element may be particularly appropriate where a roughened or textured sheet support is employed.

A receptor element according to the invention can be used as an intermediate image-receiving element in a proofing process. However, the phrase "receptor element" is used herein to have a more expansive meaning, and is not to be limited to use or functionality as an intermediate image-receiving element. By way of example only, a proof substrate can also be a "receptor element" within the definition given above, and the receptor element of the present invention can suitably be employed as a proof substrate. Furthermore, another embodiment of the invention provides a proof substrate comprising a sheet support having an image-receiving side, and disposed on the image-receiving side of the support, a coating comprising a polymeric binder and a biguanide bleaching agent; wherein the sheet support is paper or card stock.

Support for Receptor Element

The sheet support for the receptor element is chosen based on the particular imaging application. Suitable sheet supports include paper or card stock, metals (e.g., steel or aluminum), or films or plates composed of various film-forming polymers. Suitable polymeric materials include addition polymers (e.g., poly(vinylidene chloride), poly(vinyl chloride), poly(vinyl acetate), polystyrene, polyisobutylene polymers and copolymers), and linear condensation polymers (e.g., polyesters such as poly(ethylene terephthalate), poly(hexamethylene adipate), and poly(hexamethylene adipamide/adipate)). The sheet support may be transparent or opaque. Nontransparent sheet supports may be diffusely reflecting or specularly reflecting.

Suitable sheet supports for the receptor element include, for example, plastic sheet materials and films, such as polyethylene terephthalate, fluorene polyester polymers, polyethylene, polypropylene, acrylics, polyvinyl chloride and copolymers thereof, and hydrolyzed and non-hydrolyzed cellulose acetate. A particularly suitable support is a polyester film, such as a polyethylene terephthalate sheet. For example, a polyethylene terephthalate sheet sold under the name MELINEX by DuPont Teijin Films (Hopewell, Va.), such as MELINEX 574, is suitable.

In practice, the sheet support is typically about 20 μm to about 200 μm thick. If necessary, the support may be pretreated so as to modify its wettability and adhesion to subsequently applied coatings. Such surface treatments include corona discharge treatment, and application of subbing layers or release layers. The sheet support may also comprise a strippable layer containing an adhesive, such as an acrylic or vinyl acetate adhesive.

Although it is not required, it may be advantageous to include a texturized surface on the image-receiving side of the receptor element of the present invention. A texturized surface on the sheet support or the coating may be provided by a plurality of protrusions extending from a major surface of the support or coating. The protrusions can be obtained in a variety of ways. For example, a texturizing material may be included in the coating to form the protrusions, as discussed below.

Alternatively, the sheet support may itself comprise a texturized surface. For example, the sheet support may comprise a surface having a microreplicated structure made by conventional methods, thereby forming the protrusions. An example of a suitable sheet support having a texturized surface is a textured polyester film. Suitable textured polyester films are commercially available under the names MYLAR EB31 and MYLAR EB11 from DuPont Teijin Films, for instance. Where the sheet support comprises a texturized surface, it may be desirable to include a release layer on the image-receiving side of the sheet support.

Coating for Receptor Element

The coating on the receptor element generally includes a suitable polymeric binder and a biguanide bleaching agent. In some embodiments, the coating further comprises a particulate material or other texturizing material. The coating may contain optional additives such as surfactants, and antioxidants.

In one embodiment of the invention, the coating on the receptor element has a thickness in the range of about 2 to about 20 μm. In another embodiment, the coating has a coating weight in the range of about 2 to about 20 g/m$^2$.

The coating components are described further below. In an exemplary embodiment, the coating comprises (based on the solids content of the coating) about 40 to about 90 wt.-% of the polymeric binder, about 0.1 to about 35 wt.-% of poly(methyl methacrylate) beads, and about 2 to about 25 wt.-% of the biguanide bleaching agent. In one specific embodiment, the coating comprises (based on the solids content of the coating) about 40 to about 90 wt.-% of a polyvinyl butyral as the polymeric binder, about 0.1 to about 35 wt.-% of poly(methyl methacrylate) beads, and about 2 to about 25 wt.-% of 1-(o-tolyl)biguanide as the bleaching agent.

In another embodiment, the receptor element includes a sheet support having an image-receiving side, and a coating on the image-receiving side of the support, the coating including a polymeric binder and a biguanide bleaching agent; wherein said receptor element is otherwise essentially free from colorants or other image-forming materials.

Polymeric Binder

In choosing a polymeric binder, considerations include, for example, the glass transition temperature, softening point, and viscosity of the polymer, etc. A wide variety of polymeric binders are suitable for the practice of the present invention. The binder may include a hydroxylic polymer (i.e., a polymer having a plurality of hydroxy groups), or may include polymers free from hydroxy groups.

The choice of the polymeric binder for the coating on the receptor element may depend on the mechanism of colorant transfer involved (e.g., ablation, melt-stick, or sublimation). For use in an imaging system employing a melt-stick mechanism, for example, it may be advantageous to employ a similar or identical binder for the receptor element as is used as the binder of the colorant layer in the donor element. For use with commercially available donor elements sold under the designation MATCHPRINT DIGITAL HALFTONE from Kodak Polychrome Graphics (Norwalk, Conn.), BUTVAR B-76 polyvinyl butyral copolymer from Solutia, Inc. (St. Louis, Mo.) and similar thermoplastic polymers are highly suitable materials for use in the coating on the receptor element.

Another suitable polymer for use in the coating of the receptor element is a polyvinyl pyrrolidone/vinyl acetate copolymer binder available under the trade designation E-735 from International Specialty Products, Inc. (Wayne, N.J.). Another suitable polymer is a styrene/butadiene copolymer available under the trade designation PLIOLITE from Goodyear Chemical (Akron, Ohio). Yet another suitable polymer is a phenoxy resin available under the trade designation INCHEMREZ PKHM-301 from InChem Corp. (Rock Hill, S.C.).

A styrene/allyl alcohol copolymer may also be suitably included in the coating. A commercially available styrene/allyl alcohol copolymer is SAA-100 from Lyondell Chemical Company (Houston, Tex.).

Mixtures of polymers may also be suitably employed as the binder. For example, a mixture of BUTVAR B-76 and SAA-100 in a ratio of about 2:1 to about 20:1 by weight is suitable.

The materials described above are given only as non-limiting examples. Other suitable polymers will be appreciated by those skilled in the art.

Bleaching Agent

The bleaching agents useful in the coating include biguanide bleaching agents. A biguanide bleaching agent is a compound or polymer from the biguanide class of compounds (i.e., comprising a biguanide group), and that is capable of bleaching an infrared-absorbing dye that may be present after a thermal transfer imaging process.

A biguanide bleaching agent useful in the present invention is a compound or polymer that includes as the active functionality a biguanide group of the form shown in the following structure:

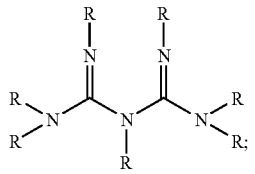

where each R can independently be hydrogen, an organic substituent as described below, or in the case of bis-biguanides and polymeric biguanide compounds, a suitable linking group.

As is well understood in this technical area, a high degree of substitution of the active functionality is not only tolerated, but is often desirable. The term "group" is used herein to indicate a chemical functional group providing the desired activity, while allowing for substitution at substitutable positions of the functional group. For example, the phrase "alkyl group" is intended to include not only hydrocarbon alkyl chains, such as methyl, ethyl, octyl, cyclohexyl, t-butyl and the like, but also alkyl chains bearing conventional substituents known in the art, such as hydroxyl, alkoxy, phenyl, halogen (F, Cl, Br and I), cyano, nitro, amino, etc.

As used herein, the term "alkyl" refers to alkyl groups of up to 20 carbons, more suitably fewer than 10 carbons, and most suitably lower alkyl, meaning up to 6 carbon atoms. The term "aryl" refers to aromatic rings or fused ring systems of up to 14, more suitably fewer than 10, and most suitably up to 6 carbon atoms. The term "alicyclic" refers to non-aromatic rings or fused ring systems of up to 14, more suitably fewer than 10, most suitably up to 6 carbon atoms. The term "heterocyclic" refers to aromatic or alicyclic rings or ring systems of up to 14, more suitably fewer than 10, and most suitably up to 6 atoms selected from carbon, nitrogen, oxygen, and sulfur.

In general, the biguanide bleaching agent used in the present invention will include one or more biguanide groups, with each biguanide group substituted with an alkyl, aryl, alicyclic, or heterocyclic substituent, which may itself be further substituted with conventional substituents. The presence of a basic nitrogen in the biguanide group may be important for obtaining the desired bleaching activity.

In one embodiment, the biguanide bleaching agent is selected from the group consisting of biguanide compounds, bis-biguanide compounds, polymeric biguanides, and mixtures thereof. Mixtures of more than one biguanide compound or polymer should be considered suitable as the bleaching agent in the practice of the invention, unless otherwise specified.

The biguanide bleaching agent may be a biguanide compound. Biguanide compounds of many types are known. Biguanide compounds have been employed as antimicrobial agents, disinfectants, oral antiplaque agents, and in antidiabetic pharmaceutical compositions.

Particularly useful in the practice of the invention are biguanide compounds in free base form. Biguanide compounds are frequently prepared in salt form for better stability, and may be useful in the present invention. Biguanide compounds in free base form, however, may be more compatible with the solvents and compositions of the present invention than biguanide compounds in salt form. Also, the free base form may provide better bleaching activity due to the higher basicity as compared to a salt form.

An aryl biguanide compound, i.e., a biguanide compound having one or more substituted or unsubstituted aryl moieties, may be suitable as the biguanide bleaching agent. By way of example, phenylbiguanide is a suitable aryl biguanide compound for the practice of the present invention. Alkylphenyl biguanide compounds, such as those having a phenyl ring with a $C_1$–$C_6$ alkyl group as a substituent, may also be suitable.

A bleaching agent that is particularly suitable in the practice of the invention is 1-(o-tolyl)biguanide, represented by the following structure:

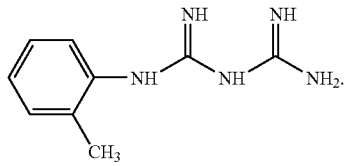

1-(o-tolyl)biguanide is available commercially from Sigma-Aldrich Corp. (St. Louis, Mo.; product number 42,466-8). 1-(o-tolyl)biguanide may also be readily synthesized using conventional methods. The compound is solid at room temperature. 1-(o-tolyl)biguanide has good stability, solubility, and compatibility with the binders disclosed herein.

1-(o-tolyl)biguanide acts as a thermal bleaching agent towards certain infrared-absorbing dyes (such as tetraarylpolymethine dyes) which are frequently used as photothermal converters in media for thermal transfer imaging. 1-(o-tolyl)biguanide is also a fast-acting bleaching agent. The invention therefore provides a convenient and effective means of removing any unwanted coloration caused by the presence of the infrared-absorbing dye as an interferent on a receptor element.

As stated above, a wide variety of biguanide compounds may be useful as the bleaching agent in the present invention. By way of example only, the 1,2-biguanide compounds described in U.S. Pat. No. 3,960,949 to Ahrens, et al., and the 1,5-disubstituted biguanide compounds described in U.S. Pat. No. 3,996,232, may be suitable as biguanide bleaching agents for use in the invention.

Bis-biguanide compounds may also be suitable as the bleaching agent in the present invention. A bis-biguanide compound known as "chlorhexidine" is a known antiseptic and disinfectant, for example. A variety of hexamethylene bis-biguanide compounds, which have two biguanide groups connected by a hexamethylene alkyl linking group, are known. By way of example only, a variety of hexamethylene bis-biguanide compounds are reported by M. Tanzer, A. M. Slee, and B. A. Kamay in "Structural Requirements of Guanide, Biguanide, and Bisbiguanide Agents for Antiplaque Activity," *Antimicrob Agents Chemother.* 12, 721 (1977).

Polymeric biguanide compounds may also be suitable as the bleaching agent. Poly(hexamethylene biguanide), also referred to as "PHMB," is a known bactericide and may be suitable for the practice of the present invention. Polymeric biguanides described in U.S. Pat. No. 4,891,423, and the references cited therein, may also be suitable.

The bleaching agent may be, and most suitably is, included in the coating on the receptor element prior to imaging. In the embodiments of the invention in which the bleaching agent is present in the coating on the receptor element, the amount of bleaching agent employed may vary considerably. The required quantity will depend on the quantity and characteristics of the infrared-absorbing dye, such as its propensity to co-transfer with the colorant during imaging, the intensity of its visible coloration, etc.

Generally, the bleaching agent may be present as about 2 wt.-% to about 25 wt.-% of the solids content of the coating. More suitably, the bleaching agent may be present as about 5 wt.-% to about 20 wt.-% of the solids content of the coating. In one embodiment, the coating comprises about 5 to about 20 parts binder to one part bleaching agent, by weight.

Texturizing Material

The coating on the receptor element may be optionally textured with a texturizing material so as to present a surface having a controlled degree of roughness. The texturizing material may be, for example, an inert particulate material such as polymeric beads, silica particles, etc. Roughness may be created by incorporating the texturizing material into the coating composition, to produce protrusions that extend from a major surface of the coating.

The presence of some surface roughness is found to be advantageous when a receptor element is brought into proximity with a donor element for imaging. When one (or both) of the donor element and receptor element presents a roughened surface, vacuum draw-down of the one to the other is facilitated. The protrusions in the receptor element regulate precisely the relationship between the donor element and the receptor element, and provide a generally uniform gap between the donor element and the receptor element during imaging. The protrusions are believed to provide channels for air to escape, so that a uniform proximity is maintained between the donor element and the receptor element. Perhaps more importantly, the protrusions are believed to prevent entrapment of air in the transferred imaged areas. As the molten or softened film transfers from the donor element to the receptor element in a given area, air can escape through channels formed by the protrusions.

As mentioned above, the texturizing material may be an inert particulate material such as, for example, polymeric beads, silica particles, metal oxide particles, inorganic salts, etc. The optimum particle size depends on a number of factors, including the thickness of the image-receiving coating, and the thickness of the material (e.g., colorant layer) to be transferred. Where laser radiation is used for imaging, the optimum size of the texturizing material, and its concentration in the coating, may depend on the spot size for the imaging laser, i.e., the diameter of the illuminated spot at the plane of the colorant layer. The spot size determines the minimum size of dot or pixel which can be transferred from donor element to receptor element. The minimum pixel size is typically in the range of about 5 μm to about 50 μm, but may be different for different designs of imaging engine. For example, the Presstek PEARLSETTER imager has a pixel size of about 30 μm diameter, while the Creo TRENDSETTER imaging device has a pixel size of about 8 μm.

The magnitude of the protrusions on the receptor element, whether formed by beads or particulate matter or by texturing, may be measured using known techniques such as interferometry or by examination of the surface using an optical or electron microscope.

The texturizing material may be of essentially uniform size (i.e., monodisperse), or may vary in size. In a typical application, the particulate material is characterized by an average particle size in the range from about 3 to about 50 μm. Dispersions of inorganic particles such as silica generally have a range of particle sizes, whereas monodisperse suspensions of polymer beads are readily available. Whichever type of population is used, the particles should not project above the plane of the surface of the receptor element by more than about 8 μm on average, but should preferably project above said plane by at least about 1 μm, and more preferably at least about 3 μm. In some constructions, it is advantageous to add two distinct sets of beads with different average sizes. This allows the flexibility to balance haze with slip or separation characteristics.

Where polymeric beads are used as texturizing material, the composition of the beads is generally chosen so that substantially all of the visible wavelengths (400 nm to 700 nm) are transmitted through the material to provide optical transparency. Nonlimiting examples of polymeric beads that have excellent optical transparency include poly(methyl methacrylate) and poly(stearyl methacrylate) beads, and beads comprising diol dimethacrylate homopolymers or copolymers. Suitable polymeric beads also include those made from polystyrene, phenol resins, melamine resins, epoxy resins, silicone resins, polyethylene, polypropylene, polyesters, polyimides, etc.

The shape of the beads is preferably spherical, oblong, ovoid, or elliptical. In general, the polymeric beads should have a particle size (i.e., average diameter) ranging from about 3 to about 50 μm, preferably from about 5 to about 25 μm. The coverage of the spacer beads in the coating may range from about 5 to about 2,000 beads/mm$^2$. As the particle size of the beads increases, then proportionally fewer beads are required.

By way of example, one suitable texturizing material includes monodisperse beads of poly(methyl methacrylate) having an average diameter of approximately 10 μm. Such beads are commercially available.

The concentration of texturizing material in the coating on the receptor element should be sufficient to provide an areal density of about 100 to about 500 particles/mm$^2$. By way of example, a suitable particle areal density is about 200 particles/mm$^2$. In one embodiment, the coating comprises about 20 to about 80 parts binder to one part texturizing material, by weight.

As an alternative to the use of beads or particles the receptor element surface may be physically textured to provide the required protrusions. Metal surfaces, such as aluminum, may be textured by graining and anodizing. Other textured surfaces may be obtained by microreplication techniques, as are known in the art.

Method for Making a Receptor Element

In another embodiment, the invention provides a method for making a receptor element. The method includes the steps of providing a sheet support having an image-receiving side, and applying a coating to the image-receiving side of the sheet support, the coating including a polymeric binder and a biguanide bleaching agent. The biguanide bleaching agent is capable of bleaching an infrared-absorbing dye transferred to the image-receiving side of the receptor element during thermal transfer imaging.

Suitable sheet supports for making the receptor element are described above.

A coating is applied to the sheet support, to make the receptor element. The coating includes a polymeric binder, and a suitable biguanide bleaching agent. These components are described above.

The coating is typically applied to the support using a coating composition comprising a solution or dispersion of the binder and the bleaching agent, in a suitable solvent or solvent mixture. The solution or dispersion may include a texturizing material, as described above. The solution or dispersion also may include any other additive that is desired in the final coating, such as surfactants or antioxidants, for example.

The suitable solvents include organic solvents or water. A suitable organic solvent is typically an alcohol, a ketone, an ether, a hydrocarbon, a haloalkane, or a mixture thereof. Suitable solvents include, for example, methanol, ethanol, propanol, 1-methoxy ethanol, 1-methoxy-2-propanol, methylethyl ketone, diethylene glycol monobutyl ether, and the like. Aromatic hydrocarbons such as toluene may also be suitable. Typically, a mixture of solvents is used, which allows for greater control of the drying rate and for avoiding the formation of cloudy films. An example of such a mixture is methyl ethyl ketone, ethanol, and 1-methoxy propanol. It may be desirable that the solvent or solvent mixture is at least moderately volatile at an elevated temperature, i.e., a temperature that is high enough to promote evaporation of the solvent, but not so high as to damage or degrade the support or any of the components of the coating solution.

Any standard coating methods may be employed for applying the coating, such as air doctor coating, blade coating, air knife coating, squeeze coating, reverse roll coating, transfer roll coating, gravure coating, kiss coating, cast coating, spray coating, dip coating, bar coating, extrusion coating, or die coating, for example. One suitable coating process employs a Meyer bar or other wire-wound metering rod.

After contacting the support layer with the coating composition, the coating composition is dried or otherwise made fast to the support to produce the coating. For the purposes of this specification, drying or other methods of making fast the coating should be considered as equivalent.

By way of example, the step of applying the coating may include drying at an elevated temperature. Drying can be accomplished by removing at least a portion of the solvent, such as by evaporation. Removal of solvent may be done by application of heat or by fan-drying or both. By way of example, for an aqueous-based coating composition, heating to 100° C. for thirty seconds or more may be sufficient to remove excess water from the coating. If a solvent-based coating composition is used, the coating may be dried by evaporating or otherwise removing solvent, while taking precautions to avoid igniting the solvent or producing unacceptable contamination of air, water, or workplace environment.

When heating at an elevated temperature is used to dry the coating, care must be exercised so that neither the coating nor the support is functionally destroyed, damaged or degraded.

In one embodiment of the method, a substantially uniform coating is applied to the support. By "substantially uniform," it is meant that the coating should have a relatively even thickness and be sufficiently free from defects (such as pinholes or voids) in the coated area.

In a variation of the method, a release layer is applied to the image-receiving side of the sheet support. The release layer generally is applied to the sheet support before the coating that contains the bleaching agent. A release layer may comprise a suitable binder or mixture of binders, for example, as described above. A release layer may be particularly appropriate where a roughened or textured sheet support is employed.

Coating Composition

The invention further provides a coating composition suitable for making a receptor element. The coating composition includes a suitable solvent, and the following components dissolved or dispersed in the solvent (where the percentages are based only on the solids content of the composition): a) 40 to 90 wt.-% of a polymeric binder; b) 2 to 25 wt.-% of a biguanide bleaching agent; and c) 0.1 to 35 wt.-% of a texturizing material. The texturizing material may be a particulate material characterized by an average particle size in the range from about 3 to about 50 μm.

The percentage of solids in the composition can be controlled to provide a desired viscosity. For example, a viscosity suitable for producing a coating having a thickness in the range of 2 to 15 μm can be achieved with a composition having about 5 to about 20% solids, based on the mass of the coating composition (i.e., solvent plus solids). More appropriately, about 10 to about 15% solids will provide a suitable coating composition. A coating composition having approximately 13% solids has been used to make a dry coating having a thickness in the range of about 5 to 6 μm.

The suitable solvent may be an organic solvent or water. A suitable organic solvent is typically an alcohol, a ketone, an ether, a hydrocarbon, a haloalkane, or a mixture thereof. Suitable solvents include, for example, methanol, ethanol, propanol, 1-methoxy ethanol, 1-methoxy-2-propanol, methylethyl ketone, diethylene glycol monobutyl ether, and the like. Aromatic hydrocarbons such as toluene may also be suitable. Typically, a mixture of solvents is used, which allows for greater control of the drying rate and for avoiding the formation of cloudy films. An example of such a mixture is methyl ethyl ketone, ethanol, and 1-methoxy propanol.

The coating composition may further comprise texturizing material, as described above. In one embodiment, the coating composition comprises about 20 to about 80 parts binder to one part texturizing material, by weight.

Generally, the bleaching agent may be present as about 2 wt.-% to about 25 wt.-% of the solids content of the coating. More suitably, the bleaching agent may be present as about 5 wt.-% to about 15 wt.-% of the solids content of the coating. In one embodiment, the coating comprises about 5 to about 20 parts binder to one part bleaching agent, by weight.

Imaging System

Also provided by the invention is an imaging system for thermal transfer imaging. The imaging system includes a color-bearing element comprising a colorant and an infrared-absorbing dye; and a bleaching element comprising a sheet support having an imaging side and a coating on the imaging side including a polymeric binder and a biguanide bleaching agent. The biguanide bleaching agent is capable of bleaching the infrared-absorbing dye when the biguanide bleaching agent and the infrared-absorbing dye are in contact.

The imaging system of the present invention is useful in the production of integral proofs, such as by laser-induced thermal transfer imaging for the production of halftone color proofs. The imaging system of the invention offers a great deal of flexibility in proofing processes, as the color-bearing element can be a donor element, an image-bearing element such as an intermediate image-receiving element, or an image-bearing proof medium, and the bleaching element can be a receptor element, a proof substrate, or a bleaching agent transfer element.

In one embodiment, the imaging system of the present invention is suitable for mass transfer of a color halftone image from a donor element to a receptor element under the influence of the energy supplied by a laser. In particular, the color-bearing element can be a donor element having a transferable colorant. Suitable donor elements are described below. When the color-bearing element is a donor element, the bleaching element can suitably be a receptor element, or a proof substrate.

The most efficient system, in which the bleaching agent is in an image-receptive coating on the receptor element, streamlines the imaging process but requires the use of the specially prepared receptor element as described above. In an alternative embodiment, the bleaching agent is in an image-receptive coating on a specially prepared proof substrate.

In another embodiment, the color-bearing element is an image-bearing element, and the bleaching element is a proof substrate. The imaging system of this embodiment is suitable for imagewise transfer of a color image from the image-bearing element to a proof substrate having a coating containing the bleaching agent. In this embodiment, the image-bearing element would generally be a conventional receptor element that is used as an intermediate image-receiving element. During processing, an image is transferred imagewise from the image-bearing element to the proof substrate. An imagewise transfer can occur under action of pressure or overall heating, for example.

In yet another embodiment, the imaging system of the present invention is suitable for transfer of a bleaching agent from a bleaching agent transfer element to an image-bearing element or an image-bearing proof substrate. In this embodiment, the bleaching element is a bleaching agent transfer element having a transferable coating containing the bleaching agent. The color-bearing element can be the image-bearing element or image-bearing proof substrate. During processing, the bleaching agent may be transferred from the bleaching agent transfer element to the image-bearing element or proof substrate. A transfer of the bleaching agent can occur under action of pressure or overall heating, for example. While this system requires an extra processing step, it does allow the use of an uncoated proof substrate, such as plain paper. Although this alternative requires extra processing steps, it has the advantage that no particular constraints are placed on the nature of the proof substrate, so that a variety of materials may be used for this purpose, including plain paper and conventional proofing bases.

A suitable bleaching agent transfer element typically comprises a support (such as polyester film) bearing a layer of a thermoplastic binder (such as BUTVAR B-76, vinyl binders, acrylic binders etc.) containing the bleaching agent in an amount corresponding to about 5 to about 25 wt.-% of the solids content, preferably about 10 to 20 wt.-%. Thus the construction of a bleaching agent transfer element is very similar to that of a receptor element in accordance with the invention, and a single construction might be suitable for either purpose. A release layer may be suitably be employed in some embodiments.

Suitable donor elements and receptor elements for the respective imaging systems are described below.

Donor Element

The donor element includes a transferable colorant and an infrared-absorbing dye. As used herein, the phrase "donor element" refers to a material, generally in sheet-form, used in thermal transfer imaging and having at least one major surface that includes a colorant capable of being transferred to a receptor element upon exposure to infrared radiation.

Suitable donor elements are known in the art, and are made by conventional methods. For example, suitable donor elements, and methods for making the donor elements, are described in U.S. Pat. No. 5,935,758 to Patel, et al. The donor element may be adapted for sublimation transfer, ablation transfer, or melt-stick transfer, for example. Typically, the donor element comprises a support (such as polyester sheet), and a coating comprising the transferable colorant and the infrared absorber, which may be in the same layer as the colorant, in a separate layer, or both. Particularly suitable donor elements are of the type reported in EP publication 0 602 893, in which the colorant layer comprises a fluorocarbon compound.

In one embodiment of the invention, a suitable donor element includes a support and a coating comprising the transferable colorant and infrared-absorbing dye. In this embodiment, the coating comprises a binder including a hydroxylic polymer, a transferable colorant, a fluorocarbon additive, a cationic infrared-absorbing dye, and a latent crosslinking agent, which are described below.

A donor element that is commercially available and is suitable for use in the imaging system is sold under the designation MATCHPRINT DIGITAL HALFTONE from Kodak Polychrome Graphics.

Transferable Colorant

The transferable colorant generally comprises one or more dyes or pigments that will provide the desired color. Preferably, the colorant comprises dyes or pigments that reproduce the colors shown by standard printing ink references provided by the International Prepress Proofing Association, known as SWOP color references.

The dyes or pigments in the colorant layer can be dispersed in a binder, although binder-free colorant layers are also possible, as reported in International Publication WO 94/04368. One consideration is that the transferable colorant should be substantially inert towards the bleaching agent of the receptor element under both ambient conditions and during the thermal transfer process. Therefore, colorants must be chosen with care and screened for possible interactions with the bleaching agent. For this reason, preferred donor elements comprise a colorant layer in the form of a dispersion of pigment particles in a binder, as this greatly reduces the likelihood of unwanted colorant bleaching.

The transferable colorant is preferably present in the colorant layer in an amount of about 10 wt.-% to about 40 wt.-%, based on the solids content of the colorant layer.

The transferable colorant can be a particulate material that is of sufficiently small particle size to be dispersed within the colorant layer, with or without the aid of a dispersant. Suitable colorants for use in the colorant layer include pigments and nonsublimable dyes. Pigments and nonsublimable polymeric dyes are suitably employed because they do not tend to migrate between layers. Pigments are more suitable due to the wide variety of colors available, low cost, and good correlation to the color of printing inks. Pigments in the form of dispersions of solid particles are preferred. Solid-particle pigments typically have a much greater resistance to bleaching or fading on prolonged exposure to sunlight, heat, humidity, etc., in comparison to soluble dyes, and hence can be used to form durable images. The use of pigment dispersions in color proofing materials is well-known in the art, and any conventional pigments useful for that purpose may be used in the present invention.

Alternatively, the donor element may comprise a transferable material that does not add color but simply enhances the color (i.e., a color enhancing additive), or is clear or colorless and provides a texturized image, or performs some other desirable function. Such transferable materials can be colorless when the infrared index of refraction matches that of the binder(s). The transferable material used in forming a color proof may also be colorless when it is desirable to simulate a spot varnish, for example. The color-enhancing additives or texturing materials may be used either alone or in combination with pigments or nonsublimable dyes to produce proofs with a desired visual effect.

By way of example, transferable materials that enhance color or perform another function include fluorescent, pearlescent, opalescent, iridescent, UV-absorbing, infrared-absorbing, ferromagnetic or metallic materials. Pigments of essentially any color may be used, including those conferring special effects such as, fluorescence, etc.

Materials such as silica, polymeric beads, reflective and non-reflective glass beads, or mica, for example, may be used as the transferable material to provide a texturized image. Such materials are typically colorless, although they may be white or have a color that does not detract from the color accuracy of the final proof.

Infrared-Absorbing Dye

The infrared-absorbing dye used in the donor is a light-to-heat converter. In some embodiments, it is a cationic dye. Cationic dyes produce transparent films when combined with a binder and other components of the colorant layer. In contrast, some neutral dyes, such as squarylium and croconium dyes, produce dispersion aggregates resulting in a colorant layer with visible agglomerated pigments. Also, anionic dyes, such as cyanine dyes, are incompatible with the transfer material of the present invention, and result in flocculation of the pigment dispersion.

Suitable cationic dyes for use in the transfer material include tetraarylpolymethine (TAPM) dyes, amine cation radical dyes, and mixtures thereof. Preferably, the dyes are the tetraarylpolymethine dyes. Dyes of these classes are typically stable when formulated with the other components of the coating from the donor element, and absorb in the correct wavelength ranges for use with the commonly available laser sources. Furthermore, dyes of these classes are believed to react with the latent crosslinking agent, described below, when photoexcited by laser radiation. This reaction not only contributes to bleaching of the infrared absorbing dye, but also leads to crosslinking of the binder, as described in greater detail below. Yet another useful property shown by many of these dyes is the ability to undergo thermal bleaching by nucleophilic compounds and reducing agents that may be incorporated in the receptor element layer, as is also described in greater detail below.

TAPM dyes comprise a polymethine chain having an odd number of carbon atoms (5 or more), each terminal carbon atom of the chain being linked to two aryl substituents. TAPM dyes generally absorb in the 700 nm to 900 nm region, making them suitable for diode laser address. Suitable TAPM dyes are described, for example, in U.S. Pat. No. 5,935,758 to Patel, et al.

During imaging, when TAPM dyes are cotransferred with pigment, a blue cast may result in the transferred image because the TAPM dyes generally have absorption peaks which tail into the red region of the spectrum. However, this problem is solved by contacting the transferred infrared-absorbing dye with a bleaching agent, as described herein.

Suitable cationic infrared-absorbing dyes include the class of amine cation radical dyes (also known as immonium dyes) reported, for example, in International Publication WO 90/12342, and in EP publication 0 739 748. Suitable cationic infrared-absorbing dyes are also described in U.S. Pat. No. 5,935,758 to Patel, et al.

The infrared-absorbing dye is preferably present in a sufficient quantity to provide a transmission optical density of at least about 0.5, more preferably, at least about 0.75, and most preferably, at least about 1.0, at the exposing wavelength. Typically, this is achieved with about 3 wt.-% to about 20 wt.-% infrared-absorbing dye, based on the solids content of the colorant layer.

Support

Suitable supports for the donor element include, for example, plastic sheets and films, such as, polyethylene terephthalate, fluorene polyester polymers, polyethylene, polypropylene, acrylics, polyvinyl chloride and copolymers thereof, and hydrolyzed and non-hydrolyzed cellulose acetate. The support needs to be sufficiently transparent to the imaging radiation emitted by the laser or laser diode to effect thermal transfer of the corresponding image to a receptor element. If necessary, the support may be surface-treated so as to modify its wettability and adhesion to subsequently applied coatings. Such surface treatments include corona discharge treatment, and the application of subbing layers or release layers.

A preferred support for the donor element is a polyethylene terephthalate sheet. Typically, the polyethylene terephthalate sheet is about 20 μm to about 200 μm thick.

Binder

The binder in the colorant layer comprises a binder which includes a hydroxylic polymer (i.e., a polymer having a plurality of hydroxy groups). Preferably, 100% of the binder is a hydroxylic polymer. The binder should be compatible with the other selected components of the colorant layer, and should be soluble in a suitable coating solvent such as lower alcohols, ketones, ethers, hydrocarbons, haloalkanes and the like.

The hydroxy groups may be alcoholic groups or phenolic groups, or both. Binders comprising predominantly alcoholic groups are suitable. A hydroxylic polymer may be obtained by polymerization or copolymerization of hydroxy-functional monomers such as allyl alcohol and hydroxyalkyl acrylates or methacrylates, or by chemical conversion of preformed polymers, e.g., by hydrolysis of polymers and copolymers of vinyl esters such as vinyl acetate. Polymers with a high degree of hydroxy functionality, such as poly(vinyl alcohol), cellulose, etc., are in principle suitable for use in the invention, but in practice the infrared solubility and other physico-chemical properties are less than ideal for most applications. Derivatives of such polymers, obtained by esterification, etherification, or acetalization of the bulk of the hydroxy groups, generally exhibit superior solubility and film-forming properties, and provided that at least a minor proportion of the hydroxy groups remain unreacted, they are suitable for use in the invention.

One suitable hydroxy-functional polymer for use as the binder is a reaction product formed by reacting poly(vinyl alcohol) with butyraldehyde. Commercial grades of this reaction product typically leave at least 5% of the hydroxy groups unreacted (i.e., free), and are generally in common organic solvents and possess excellent film-forming and pigment-dispersing properties.

A commercially available hydroxylic polymer that is suitable is a polyvinyl butyral polymer available under the trade designation BUTVAR B-76 from Solutia, Inc. (St. Louis, Mo.). This particular polymer has a softening range of about 140° C. to about 200° C. Other hydroxylic binders from the BUTVAR series of polymers may also be used. Polyvinyl butyral polymers available under the trade designations MOWITAL from Kuraray America, Inc. (New York, N.Y.) are also suitable.

Alternatively, a blend of one or more non-crosslinkable binders with one or more hydroxy-functional binders may be used. A non-crosslinkable binder should be compatible with the imaging system of the present invention such that it does not interfere with the transfer of colorant. That is, it should be nonreactive when exposed to the conditions used during imaging. Suitable non-crosslinkable binders include, for example, polyesters, polyamides, polycarbamates, polyolefins, polystyrenes, polyethers, polyvinyl ethers, polyvinyl esters, polyacrylates, polymethacrylates, and the like. An example of a suitable commercially available non-crosslinkable binder that can be combined with the hydroxylic binders described above in the colorant layer includes poly (methyl methacrylate) available under the trade designation ELVACITE from DuPont (Wilmington, Del.). Polymers that decompose under laser address imaging conditions are less suitable as binders, although not entirely unusable. For example, polymers and copolymers of vinyl chloride are less desirable because they can decompose to release chlorine, which leads to discoloration and problems with accurate color match.

The total binder is typically present in an amount of about 25 wt.-% to about 75 wt.-%, and more suitably in an amount of about 35 wt.-% to about 65 wt.-%, based on the solids content of the colorant layer.

Fluorocarbon Additive

The colorant layer generally also includes a fluorocarbon additive for enhancing transfer of a molten or softened film and production of halftone dots (i.e., pixels) having well-defined, generally continuous, and relatively sharp edges. Under imaging conditions, it is believed that the fluorocarbon additive serves to reduce cohesive forces within the colorant layer at the interface between the laser-exposed heated regions and the unexposed regions, and thereby promotes clean "shearing" of the exposed regions in the direction perpendicular to the major surface of the colorant layer. This provides improved integrity of the dots with sharper edges, as there is less tendency for "tearing" or other distortion as the exposed regions separate from the rest of the colorant layer.

A wide variety of compounds may be employed as the fluorocarbon additive, provided that the chosen additive is substantially involatile under normal coating and drying conditions, and is sufficiently compatible with the binder material(s). Thus, highly insoluble fluorocarbon binders, such as polytetrafluoroethylene and polyvinylidenefluoride, are unsuitable, as are gases and low boiling liquids, such as perfluoralkanes. With the above exceptions, both polymeric and lower molecular weight materials may be used.

Suitable fluorocarbon additives are described in U.S. Pat. No. 5,935,758 to Patel, et al. Other suitable fluorocarbon compounds are reported in EP publication 0 602 893 and the references cited therein. A preferred fluorocarbon additive is a sulfonamido compound N-ethyl perfluorooctanesulfonamide having the formula $(C_8F_{17})SO_2NH(CH_2CH_3)$, which includes 70% straight chains and 30% branched chains. The fluorocarbon additive is typically used in an amount of about 1 weight percent to about 10 weight percent, based on the dry coating weight of the colorant layer. Preferably, the weight ratio of fluorocarbon additive to transferable colorant is at least about 1:10, and more preferably at least about 1:5.

Latent Crosslinking Agent

As used herein, a "latent crosslinking agent" is a compound that is capable of causing crosslinking only under conditions of laser address. Suitable latent crosslinking agents include compounds derived from dihydropyridine, for example. Suitable derivatives of dihydropyridine can be substituted at any of the ring positions with appropriate substituents, such as alkyl or aryl groups. In particular, 3,5-dicarboxylic diester derivatives of dihydropyridine are suitable as latent crosslinking agents. Polymers comprising a 3,5-dicarboxylic diester derivative of dihydropyridine integrated into the polymer backbone may also be suitable. Latent crosslinking agents that are useful in the colorant layer are described in U.S. Pat. No. 5,935,758 to Patel, et al.

This latent crosslinking agent is present in the colorant layer in an amount of up to about 30 wt.-%, based on the solids content of the colorant layer. Alternatively, a latent crosslinking agent can be present in the receptor element.

The latent crosslinking agent is believed to be important for providing cohesion within the transferred colorant. This complements the action of the fluorocarbon additive, and results in transfer of the exposed region as a coherent film. It is also believed to be important for preventing retransfer of colorant back to the donor element, as well as back-transfer of colorant to a separate donor element in a subsequent imaging step.

It is believed that during laser imaging, the latent crosslinking agent reacts with the photoexcited infrared absorbing dye to form the corresponding pyridinium compound, which is activated to crosslink the hydroxylic binder. Thus, crosslinking occurs during laser imaging.

Optional Additives

Coating aids, dispersing agents, optical brighteners, UV absorbers, fillers, etc., can also be incorporated into the colorant layer. The various additives are well-known in the art.

Dispersing agents, or "dispersants," may be desirable to achieve optimum dispersion quality. Some examples of dispersing agents include, for example, polyester/polyamine copolymers, alkylarylpolyether alcohols, acrylic binders, and wetting agents. One suitable dispersant in the colorant layer is a block copolymer with pigment-affinic groups, which is available under the trade designation DISPERBYK 161 from Byk-Chemie USA (Wallingford, Conn.). The dispersing agent is preferably used in the dispersion in an amount of about 1 wt.-% to about 6 wt.-%, based on the solids content of the colorant layer.

Surfactants may be used as a coating aid to improve solution stability. A wide variety of surfactants can be used. One suitable surfactant is a fluorocarbon surfactant used in the colorant layer to improve coating quality. Suitable fluorocarbon surfactants include fluorinated polymers, such as the fluorinated polymers described in U.S. Pat. No. 5,380,644 to Yonkoski, et al. A suitable quantity may be in the range of about 0.05 wt.-%, and less than about 5 wt.-%, and typically is in the range of about 1 to 2 wt.-%.

Receptor Element

As stated previously, a suitable receptor element is a material, generally in sheet-form, having at least one major surface that is capable of imagewise accepting colorant transferred from a color-bearing element, such as a donor element, in thermal transfer imaging. The conventional construction of a receptor element for the imaging systems is described above. Conventional receptor elements may suitably be employed in the imaging systems, such as where an intermediate image-receiving element is needed during image processing.

Where the receptor element is required to be a bleaching element, receptor elements according to the present invention as described above are suitable for use in the imaging system. Such a receptor element includes a sheet support having an image-receiving side, and a coating on the image-receiving side of the support including a polymeric binder and a biguanide bleaching agent. The biguanide bleaching agent is capable of bleaching an infrared-absorbing dye when the biguanide bleaching agent and the infrared-absorbing dye are in contact. The coating can include a texturizing material, and may include other additives such as surfactants or antioxidants.

Proof Substrate

As used herein, the phrase "proof substrate" refers to a material, generally in sheet-form, having at least one major surface that is capable of imagewise accepting colorant transferred from an image-bearing element or directly from a donor element. A proof substrate should be suitable for use in a final pre-press proof such as a surprint proof, and is generally made from paper or card stock, although other materials may also be suitable.

Conventional proof substrates may suitably be employed in the imaging systems. Examples of suitable proof substrates include MATCHPRINT Low Gain Commercial Base, MATCHPRINT Commercial Base, MATCHPRINT Publication Base, and MATCHPRINT Superwhite Base, each available from Kodak Polychrome Graphics. Each of these proof substrates is a heat-stable, waterproof material that includes a paper sheet sandwiched between two polyethylene layers.

Where the proof substrate is required to be a bleaching element, the proof substrate can be a receptor element according to the present invention as described above. Such a proof substrate includes a sheet support having an image-receiving side, and a coating on the image-receiving side of the support including a polymeric binder and a biguanide bleaching agent. The biguanide bleaching agent is capable of bleaching an infrared-absorbing dye when the biguanide bleaching agent and the infrared-absorbing dye are in contact. Furthermore, another embodiment of the invention provides a proof substrate comprising a sheet support having an image-receiving side, and disposed on the image-receiving side of the support, a coating comprising a polymeric binder and a biguanide bleaching agent; wherein the sheet support is paper or card stock.

Method for Making an Imaged Element

Methods useful in the production of an integral proof are also provided by the invention. The methods include the steps of: a) providing a color-bearing element comprising a transferable colorant and an infrared-absorbing dye; b) providing a bleaching element comprising a sheet support and having a coating on an image-receiving side of the sheet support, the coating including a polymeric binder and a biguanide bleaching agent; c) assembling the color-bearing element and the bleaching element in close proximity, with the image-receiving side of the bleaching element adjacent to the color-bearing element; and d) imagewise transferring colorant from the color-bearing element to the image-receiving side of the bleaching element.

The methods provided by the invention offer a great deal of flexibility in proofing processes, as the color-bearing element can be a donor element or an image-bearing element such as an intermediate image-receiving element, and the bleaching element can be a receptor element or a proof substrate.

In one embodiment of the method, the color-bearing element is a donor element as described above, and the bleaching element is a receptor element. Conventional procedures for imagewise transfer of colorant from donor element to receptor element can be used. Generally, the donor element and receptor element are assembled in close proximity, with the image-receiving side of the receptor element adjacent to the donor element. The phrase "close proximity" in this context can mean that the elements are brought into contact, or that they do not contact each other but are sufficiently close to allow transfer of colorant upon exposure to imaging radiation. Vacuum hold-down or a mechanical means may be used to secure the donor element and receptor element in assembly.

In one embodiment, the step of imagewise transferring colorant includes imagewise exposing the assembly of the donor and receptor elements using infrared radiation, to cause imagewise transfer of colorant from the donor element to the receptor element. Infrared radiation may be provided, for example, by an infrared laser such as a diode laser or a Nd:YAG laser, which may be scanned or rasterized under computer control. Any of the known scanning devices may be used, e.g., flat-bed scanners, external drum scanners or internal drum scanners. In these devices, the assembly to be imaged is secured to the drum or bed, and the laser beam is focused to a spot that can impinge on the colorant layer of the donor element. The laser spot is scanned over the entire area to be imaged while the laser output is modulated in accordance with electronically stored image information. Two or more lasers may scan different areas of the assembly simultaneously, to increase throughput. Laser address is normally from the donor-element side of the assembly, but may be from the receptor-element side if the receptor element is transparent to the laser radiation.

After imaging, the donor element may be peeled away from the receptor element to reveal an image on the receptor element that will in most cases be contaminated by co-transfer of the infrared-absorbing dye. In such a situation, the bleaching agent on the receptor element is capable of bleaching the infrared-absorbing dye.

In some embodiments, the image residing on the receptor element may optionally be cured by subjecting it to heat treatment, preferably at temperatures in excess of about 100° F. Heat treatment may be done by a variety of means, such as storage in an oven, hot air treatment, contact with a heated platen or passage through a heated roller device. Heat treatment may also be effective to initiate a thermal bleaching agent. In the case of multi-color imaging (described more fully below), where two or more monochrome images are transferred from separate donor elements to a single receptor element, it is more convenient to delay the curing step until all the separate colorant transfer steps have been completed. However, if the individual transferred images are particularly soft or easily damaged in their uncured state, then it may be necessary to cure and harden each monochrome image prior to the next transfer step. In other embodiments, heat treatment is not necessary for curing to take place.

In another embodiment of the method, steps a) through d) may be repeated one or more times using donor element sheets of different colors, and separate receptor elements. After each iteration, the transferred colorant may be subsequently imagewise transferred in register from the respective image-bearing receptor element to a proof substrate (with the sheet support of each receptor element being peeled away from the proof substrate). In this manner, a multi-color image may be built up on the proof substrate. Although this embodiment is adequate for making an overprint or surprint proof, the method described below for making a surprint proof is more efficient with respect to time and materials, and generally provides more accuracy in terms of registration of the multi-colored image.

The method described above is also suitable for direct imagewise transfer of colorant from a donor element to a proof substrate. In another embodiment of the method, steps a) through d) may be repeated one or more times using donor element sheets of different colors, and a single proof substrate as the bleaching element. In this manner, a multi-color image may be built up on the proof substrate. Although this embodiment is adequate for making an overprint or surprint proof, the method described below for making a surprint proof generally provides more accuracy in terms of registration of the multi-colored image.

In many situations, colorant is initially imagewise transferred to an intermediate image-receiving element, which is not the final substrate on which the image is viewed. Often the colorant is subsequently transferred to another medium such as a proof substrate for proofing purposes, for example. Accordingly, in another embodiment of the method, the color-bearing element is an image-bearing element (such as an image-bearing intermediate element) and the bleaching element is a proof substrate. After imagewise transfer, the intermediate element is an image-bearing intermediate element. The colorant may then be imagewise transferred from the image-bearing intermediate element to another support, such as a proof substrate.

Imagewise transfer of colorant from the image-bearing intermediate element to a proof substrate can generally be done by bringing the image-bearing side of the intermediate element into close proximity with an image-receiving side of the proof substrate, and then overall heating the intermediate element to cause imagewise transfer of the colorant to the proof substrate. The sheet support of the intermediate element may then be peeled away from the proof substrate, to reveal the image on the proof substrate. Imagewise transfer of colorant may also be achieved by action of pressure or overall heating of the assembly of the color-bearing and bleaching elements in some cases. Heating may additionally be effective to initiate a thermal bleaching agent.

Method for Making an Integral Proof

The invention also includes a method for making an integral proof, such as a surprint proof, having an image that includes at least two colors. The method includes the steps of: a) providing a donor element comprising a transferable colorant and an infrared-absorbing dye; b) providing a receptor element comprising a sheet support and having a coating on an image-receiving side of the sheet support, the coating including a polymeric binder and a biguanide bleaching agent; c) assembling the donor element and the receptor element in close proximity, with the image-receiving side of the receptor sheet support adjacent to the donor element; d) imagewise exposing the assembly of the donor and receptor elements using infrared radiation, to cause imagewise transfer of colorant from the donor element to the receptor element; e) providing a second donor element comprising a second transferable colorant and an second infrared-absorbing dye; f) assembling the second donor element and the receptor element in close proximity, with the image-receiving side of the receptor sheet support adjacent to the second donor element; g) imagewise exposing in register the assembly of the second donor and receptor elements using infrared radiation, to cause imagewise transfer of colorant from the second donor element to the receptor element; and h) imagewise transferring the transferred colorant from the receptor element to a proof substrate.

Steps a) through d) are carried out as described above with respect to methods for making an imaged element. Steps e) through g) are done similarly, using a second donor element having a second transferable colorant and a second infrared-absorbing dye. Generally, the second donor element will have a different color than the first donor element. The second infrared-absorbing dye may be the same as the first infrared-absorbing dye, or it may be different. The second donor element and the receptor element are assembled in close proximity, with the image-bearing side of the receptor element adjacent to the second donor element. The assembly is then imagewise exposed in register using infrared radiation, to cause imagewise transfer of colorant from the second donor element to the receptor element. The imagewise exposure must be done in register so that the two-color image on the receptor element will accurately represent the final prints obtained on-press.

Steps e) through g) may be likewise repeated using a third donor element in a third color, and optionally a fourth donor element in a fourth color, etc. A multi-colored image may be built up on the receptor element in this fashion. Commonly, the multi-colored image on the receptor element can be used to make a four-color proof such as a CMYK proof. It is not uncommon for a proof to have even five or six colors, where the additional colors are spot colors or custom colors.

In a subsequent step, the transferred colorant is imagewise transferred from the image-bearing receptor element to a proof substrate. Imagewise transfer of colorant from the receptor element to a proof substrate can generally be done by bringing the image-bearing side of the receptor element into contact with an image-receiving side of the proof substrate, and then overall heating the receptor element to cause transfer of the colorant to the proof substrate. The sheet support of the receptor element may then be peeled away from the proof substrate, to reveal the image on the proof substrate. Imagewise transfer of colorant may also be achieved by action of pressure or overall heating of the assembly of the receptor element and proof substrate in some cases.

An example of a suitable proof substrate is the MATCHPRINT Low Gain Commercial Base available from Kodak Polychrome Graphics.

EXAMPLES

Example 1

Coating Composition Comprising 1-(o-tolyl)biguanide

A coating composition was made according to the formulation given in Table 1.

TABLE 1

Coating formulation comprising 1-(o-tolyl)biguanide.

| Component | Quantity (g) | Wt.-% based on solids content |
|---|---|---|
| BUTVAR B-76 (binder), 10% solids in methyl ethyl ketone | 37.03 | 74.05 |
| Styrene/allyl alcohol SAA-100 (binder), 100% solids | 0.86 | 17.25 |
| 1-(o-tolyl)biguanide | 0.38 | 7.5 |
| 10.5 μm poly(methyl methacrylate) beads, 10% solution in methyl ethyl ketone | 0.6 | 1.2 |
| Methylethyl ketone (MEK) | 1.14 | — |

Example 2

Coating Composition Comprising Phenylbiguanide

A coating composition was made as in Example 1, except that phenylbiguanide was used in place of 1-(o-tolyl)biguanide.

Example 3

Coating Composition Comprising Phenylbiguanide Hydrochloride

A coating composition was made as in Example 1, except that phenylbiguanide hydrochloride was used in place of 1-(o-tolyl)biguanide.

Comparative Example 4

Coating Composition Comprising Diphenylguanidine

A coating composition was made according to the formulation given in Table 2.

TABLE 2

Coating formulation comprising diphenylguanidine.

| Component | Quantity (g) | Wt.-% based on solids content |
|---|---|---|
| BUTVAR B-76 (binder), 10% solids in methyl ethyl ketone | 33.52 | 67.04 |
| Styrene/allyl alcohol SAA-100 (binder), 100% solids | 0.84 | 16.76 |
| Diphenylguanidine | 0.75 | 15 |

TABLE 2-continued

Coating formulation comprising diphenylguanidine.

| Component | Quantity (g) | Wt.-% based on solids content |
|---|---|---|
| 10.5 μm poly(methyl methacrylate) beads, 10% solution in methyl ethyl ketone | 0.6 | 1.2 |
| Methylethyl ketone (MEK) | 4.29 | — |

Example 5

Receptor Element Having a Coating Containing 1-(o-tolyl)biguanide

A first receptor element (5-1) was made by applying the coating composition from Example 1 onto a polyester sheet (MELINEX 574) using a #38 Meyer bar. The coating composition contained approximately 13% solids, and was suitable for producing a coating having a thickness of approximately 5 μm when dry. The coating was dried at a temperature of 200° F. for 180 seconds.

A second receptor element (5-2) was made as in Example 5, except that the coating composition from Example 2 was used in place of the coating composition from Example 1, MYLAR EB 31 was used in place of MELINEX 574, and a release layer was applied to the MYLAR sheet prior to application of the coating composition. The release layer was applied using a composition consisting of 5% by weight PLIOLITE S-5A in a 50:50 (w:w) toluene/MEK solvent mixture. The release layer was applied using a #10 Meyer bar.

A third receptor element (5-3) was made as in Example 5, except that the coating composition from Example 2 was used in place of the coating composition from Example 1, and MYLAR EB 11 was used in place of MELINEX 574, and a release layer was applied to the MYLAR sheet prior to application of the coating composition. The release layer was applied using a composition consisting of 5% by weight PLIOLITE S-5A in a 50:50 (w:w) toluene/MEK solvent mixture. The release layer was applied using a #10 Meyer bar.

Example 6

Receptor Elements Having a Coating Containing Phenylbiguanide

A receptor element was made as in Example 5, except that the coating composition from Example 2 was used in place of the coating composition from Example 1.

Example 7

Receptor Elements Having a Coating Containing Phenylbiguanide Hydrochloride

A receptor element was prepared as in Example 5, except that the coating composition from Example 3 was used in place of the coating composition from Example 1, and a #50 Meyer bar was used in place of the #38 Meyer bar.

Comparative Example 8

Receptor Element Having a Coating Containing Diphenylguanidine

A receptor element was made by applying the coating composition from Comparative Example 4 onto a polyester sheet (MELINEX 574) using a #38 Meyer bar. The coating composition contained approximately 13% solids, and was suitable for producing a coating having a thickness of approximately 5 μm when dry. The coating was dried at a temperature of 200° F. for 180 seconds.

Example 9

Imaged Element Made from a Receptor Element Having a Coating Containing 1-(o-tolyl)biguanide The image-receiving side of receptor element 5-1 from Example 5 was placed adjacent to and in close proximity with the colorant layer of a cyan-colored MATCHPRINT DIGITAL HALFTONE donor element, available from Kodak Polychrome Graphics. The donor element contains an infrared dye in its colorant layer, which can transfer upon imaging and leave the infrared dye on the receptor element as an interferent in the visible region of the spectrum.

The assembly was imagewise exposed to infrared radiation at 830 nm using a TRENDSETTER imager from Creo, Inc. (Burnaby, British Columbia). The imaged receptor element was peeled away from the donor element. The image-bearing side of the receptor element was then placed in contact with the image-receiving surface of a proof substrate (MATCHPRINT COMMERCIAL BASE, available from Kodak Polychrome Graphics). Colorant from the image-bearing receptor element was then transferred imagewise to the proof substrate under heat using a Model 447L Laminator (available from Kodak Polychrome Graphics). The sheet support from the receptor element was then peeled away from the proof substrate, leaving a right-reading image on the proof substrate. The resulting imaged element 9-1 was obtained.

The procedure was repeated, except that the receptor element 5-2 was used in place of the receptor element 5-1. Imaged element 9-2 was obtained.

The procedure was repeated, except that the receptor element 5-3 was used in place of the receptor element 5-1. Imaged element 9-3 was obtained.

Example 10

Imaged Element Made from a Receptor Element Having a Coating Containing Phenylbiguanide The procedure for Example 9 was repeated, except that the receptor element from Example 6 was used in place of the receptor element 5-1.

The rate of bleaching of the infrared-absorbing dye was thought to be lower than for the imaged elements obtained in Example 9. This effect may be due to the lower solubility of phenylbiguanide in the coating composition, as compared to 1-(o-tolyl)biguanide.

Example 11

Imaged Element Made from a Receptor Element Having a Coating Containing Phenylbiguanide Hydrochloride The procedure for Example 9 was repeated, except that the receptor element from Example 7 was used in place of the receptor element 5-1.

Comparative Example 12

Imaged Element Made from a Receptor Element Having a Coating Containing Diphenylguanidine The image-receiving side of the receptor element from Comparative Example 2 was placed adjacent to and in close proximity with the colorant layer of a cyan-colored MATCHPRINT DIGITAL HALFTONE donor element. The assembly was imagewise exposed to infrared radiation at 830 nm using a Creo TRENDSETTER imager. The imaged receptor element was peeled away from the donor element. The image-bearing side of the receptor element was then placed in contact with the image-receiving surface of a proof substrate (MATCHPRINT COMMERCIAL BASE). Colorant from the image-bearing receptor element was then transferred imagewise to the proof substrate under heat using a Model 447L Laminator. The sheet support from the receptor element was then peeled away from the proof substrate, leaving a right-reading image on the proof substrate. The resulting imaged element was obtained.

Example 13

ΔE and Change in Chroma for Imaged Elements of Example 9.

The color of the image on the imaged element 9-1 from Example 9 was analyzed to obtain initial L*a*b* values. All L*a*b* values given in these Examples were measured using a SPM 100 Spectrophotometer from GretagMacbeth LLC (New Windsor, N.Y.). Chroma (c*) was calculated from the a* and b* values by the formula:

$$c^*=\sqrt{(a^*)^2+(b^*)^2}.$$

The imaged element was then subjected to an accelerated aging by heating in an oven at 95° C. for three minutes. The color of the image on the imaged element was analyzed to obtain post-aging L*a*b* values, and c* was calculated from a* and b*.

ΔE was calculated using the initial L*a*b* values and the post-aging L*a*b* values. The formula for calculating ΔE in the L*a*b* color model is as follows:

$$\Delta E=\sqrt{(L_2^*-L_1^*)^2+(a_2^*-a_1^*)^2+(b_2^*-b_1^*)^2}.$$

In the L*a*b* model, ΔE is used to mathematically describe the "distance" between two colors in the L*a*b* color space. The significance of the magnitude of ΔE is strongly dependent on the colors. For intense colors, a casual viewer can notice the difference between two colors for which ΔE is in the range of about 4 to 5. A trained eye is capable of differentiating two colors for which ΔE is in the range of about 2 to 3. For shades of white or gray, color differences where ΔE is in the range 0.5 to 1 may be perceptible.

For the image on the imaged element 9-1, ΔE was calculated to be 0.79 when comparing the initial L*a*b* values to the post-aging L*a*b* values, which is an imperceptible difference for the cyan image. For a second such imaged element prepared similarly, ΔE was calculated to be 0.89.

Also, a percentage change in chroma was calculated to compare initial chroma to post-aging chroma. The percentage change in c* was calculated to be 0.75%, indicating that the image became only very slightly more vivid upon aging. For the second imaged element, percentage change in c* was calculated to be 0.66%.

For the image on the imaged element 9-2, measurements and accelerated aging were done as above. ΔE was calculated to be 0.84 when comparing the initial L*a*b* values to the post-aging L*a*b* values. The percentage change in c* was calculated to be 0.95%.

For the image on the imaged element 9-3, measurements and accelerated aging were done as above. ΔE was calculated to be 2.38 when comparing the initial L*a*b* values to the post-aging L*a*b* values. The percentage change in c* was calculated to be 3.03%.

Example 14

ΔE and Change in Chroma for Imaged Elements of Example 10

For the image on the imaged element from Example 10, measurements and accelerated aging were done as in Example 13. ΔE was calculated to be 5.54 when comparing the initial L*a*b* values to the post-aging L*a*b* values. The percentage change in c* was calculated to be 6.65%.

Example 15

ΔE and Change in Chroma for Imaged Elements of Example 11

For the image on the imaged element from Example 11, measurements and accelerated aging were done as in Example 13. ΔE was calculated to be 5.29 when comparing the initial L*a*b* values to the post-aging L*a*b* values. The percentage change in c* was calculated to be 8.13%.

The bleaching of the infrared-absorbing dye is thought to be less effective due to the lower solubility of phenylbiguanide hydrochloride in the coating composition as compared to free base biguanide compounds, and to the fact that phenylbiguanide hydrochloride is not as basic as free base biguanide compounds.

Comparative Example 16

ΔE and Change in Chroma for the Imaged Element from Comparative Example 12

The color of the image on the imaged element from Comparative Example 12 was analyzed to obtain initial L*a*b* values. Chroma (c*) was calculated from a* and b*.

The imaged element was then subjected to an accelerated aging by heating in an oven at 95° C. for three minutes. The color of the image on the imaged element was analyzed to obtain post-aging L*a*b* values, and c* was calculated.

For the image on the imaged element, ΔE was calculated to be 6.57 between the initial L*a*b* values to the post-aging L*a*b* values, which is a discernible difference for the cyan image.

Also, a percentage change in chroma was calculated to compare initial chroma to post-aging chroma. The percentage change in c* was calculated to be 9.32%, indicating that the image became significantly more vivid upon aging.

The results from the above Examples indicate that a receptor element having a coating containing a biguanide bleaching agent provides higher color fidelity when compared to an equivalent receptor element containing diphenylguanidine.

In particular, 1-(o-tolyl)biguanide is more efficient and faster-acting than diphenylguanidine, and provides superior color fidelity when compared to an equivalent receptor element containing diphenylguanidine. Furthermore, 1-(o-tolyl)biguanide is effective at a lower concentration of bleaching agent in the coating than is required when diphenylguanidine is used as the bleaching agent.

Example 5

Surprint Proof Made Using a Receptor Element Having a Coating Containing 1-(o-tolyl)biguanide A four-color surprint proof can be made as follows:

The image-receiving side of a receptor element from any of Examples 5 through 7 is placed adjacent to and in close proximity with the colorant layer of a black-colored MATCHPRINT DIGITAL HALFTONE donor element, available from Kodak Polychrome Graphics. The assembly is imagewise exposed to infrared radiation at 830 nm using a Creo TRENDSETTER imager, using appropriate color-separation data. The imaged receptor element is peeled away from the donor element.

Next, the image-bearing side of the receptor element is placed adjacent to and in close proximity with the colorant layer of a cyan-colored MATCHPRINT DIGITAL HALFTONE donor element. The assembly is imagewise exposed to infrared radiation at 830 nm using a TRENDSETTER imager and using appropriate color-separation data. The imaged receptor element is peeled away from the donor element. Magenta and yellow donor elements are respectively imaged in a likewise fashion to create a four-color image on the receptor element.

The image-bearing side of the receptor element is then placed in contact with the image-receiving surface of a proof substrate (MATCHPRINT COMMERCIAL BASE). Colorant from the image-bearing receptor element is then transferred imagewise to the proof substrate under heat using a Model 447L Laminator (available from Kodak Polychrome Graphics). The sheet support from the receptor element is then peeled away from the proof substrate, leaving a right-reading four-color image on the proof substrate. The resulting surprint proof is suitable as a contract proof.

An optional deglossing step may be performed to reduce the glossiness of the surprint proof. By way of example, the image-bearing side of the surprint proof may be placed in contact with a MATCHPRINT Digital Halftone Semi-Matte Degloss Sheet and processed through the Model 447L Laminator.

The foregoing detailed description and examples have been given for clarity of understanding only. The invention is not limited to the exact details shown and described. This invention may take on various modifications and alterations without departing from the spirit and scope thereof. It is also to be understood that this invention may be suitably practiced in the absence of any element not specifically disclosed herein. In describing preferred embodiments of the invention, specific terminology is used for the sake of clarity. The invention, however, is not intended to be limited to the specific terms so selected, and it is to be understood that each term so selected includes all technical equivalents that operate similarly.

What is claimed is:

1. A receptor element for use in thermal transfer imaging, comprising:

a) a sheet support having an image-receiving side; and b) disposed on the image-receiving side of the support, a coating comprising a polymeric binder and a non-polymeric biguanide agent for bleaching an infrared-absorbing dye transferred to the image-receiving side of the receptor element during thermal transfer imaging.

2. The receptor element of claim 1, wherein the biguanide agent is a biguanide compound in free base form.

3. The receptor element of claim 2, wherein the biguanide compound is an aryl biguanide compound.

4. The receptor element of claim 3, wherein the aryl biguanide compound is phenylbiguanide.

5. The receptor element of claim 3, wherein the aryl biguanide compound is an alkylphenyl biguanide compound.

6. The receptor element of claim 5, wherein the alkylphenyl biguanide compound comprises a phenyl ring having at least one $C_1$–$C_6$ alkyl group as a substituent.

7. The receptor element of claim 5, wherein the alkylphenyl biguanide compound is 1-(o-tolyl)biguanide.

8. The receptor element of claim 1, wherein the support comprises a polyester film.

9. The receptor element of claim 1, wherein the support comprises a textured polyester film.

10. The receptor element of claim 1, wherein the binder includes a hydroxylic polymer.

11. The receptor element of claim 1, wherein the binder comprises polyvinyl butyral.

12. The receptor element of claim 1, wherein the binder comprises a styrene/allyl alcohol copolymer.

13. The receptor element of claim 1, wherein the coating comprises about 5 to about 20 parts binder to one part biguanide agent, by weight.

14. The receptor element of claim 1, wherein the coating further comprises a particulate material characterized by an average particle size in the range from about 3 to about 50 μm.

15. The receptor element of claim 14, wherein the coating comprises about 20 to about 80 parts binder to one part particulate material, by weight.

16. The receptor element of claim 14, wherein the particulate material comprises polymeric beads having an average diameter in the range from about 3 to about 50 μm.

17. The receptor element of claim 16, wherein the particulate material comprises polymeric beads having an average diameter in the range from about 5 to about 25 μm.

18. The receptor element of claim 16, wherein the polymeric beads comprise poly(methyl methacrylate) beads.

19. The receptor element of claim 16, wherein the polymeric beads comprise poly(methyl methacrylate) beads having an average diameter of about 10 μm.

20. The receptor element of claim 1, wherein the coating has a thickness of about 2 μm to about 20 μm.

21. The receptor element of claim 1, wherein the coating comprises:

40 to 90 wt.-%, based on the solids content of the coating, of the polymeric binder;

0.1 to 35 wt.-%, based on the solids content of the coating, of poly(methyl methacrylate) beads; and 2 to 25 wt.-%, based on the solids content of the coating, of the biguanide agent.

22. The receptor element of claim 1, wherein the coating comprises:

40 to 90 wt.-%, based on the solids content of the coating, of a polyvinyl butyral as the polymeric binder;

0.1 to 35 wt.-%, based on the solids content of the coating, of poly(methyl methacrylate) beads; and 2 to 25 wt.-%, based on the solids content of the coating, of 1-o-tolyl)biguanide as the biguanide agent.

23. The receptor element of claim 1, further comprising a release layer disposed between the sheet support and the coating.

24. The receptor element of claim 23, wherein the release layer comprises a styrene/butadiene copolymer.

25. The receptor element of claim 1, wherein the receptor element is a proof substrate.

26. The receptor element of claim 25, wherein the sheet support is paper or card stock.

27. A bleaching agent transfer element, comprising a sheet support; and disposed on the support, a transferable coating comprising a polymeric binder and a biguanide bleaching agent for bleaching an infrared-absorbing dye contacted by the transferable coating during thermal transfer imaging.

28. The bleaching agent transfer element of claim 27, further comprising a release layer disposed between the sheet support and the transferable coating.

29. A method for making a receptor element for thermal transfer imaging, comprising:

providing a sheet support having an image-receiving side; and applying a coating to the image-receiving side of the sheet support, the coating comprising a polymeric binder and a non-polymeric biguanide agent for bleaching an infrared-absorbing dye transferred to the image-receiving side of the receptor element during thermal transfer imaging.

30. The method of claim 29, wherein the step of applying a coating includes:

dissolving or dispersing the polymeric binder and the biguanide agent in a suitable solvent or solvent mixture to make a coating composition;

contacting the coating composition to the image-receiving side of the sheet support to produce a layer of the coating composition on the sheet support; and drying the coating composition to remove at least some of the solvent, to leave the coating on the sheet support.

31. The method of claim 29, wherein the step of applying a coating further includes applying a release layer to the image-receiving side of the sheet support.

32. A coating composition for manufacturing a receptor element, comprising:

40 to 90 wt.-%, based on the solids content of the composition, of a polymeric binder;

2 to 25 wt.-%, based on the solids content of the composition, of a non-polymeric biguanide bleaching agent; and 0.1 to 35 wt.-%, based on the solids content of the composition, of a particulate material characterized by an average particle size in the range from about 3 to about 50 μm;

dissolved or dispersed in a suitable solvent.

33. The coating composition of claim 32, wherein the biguanide bleaching agent is a biguanide compound in free base from.

34. The coating composition of claim 33, wherein the biguanide compound is an aryl biguanide compound.

35. The coating composition of claim 34, wherein the aryl biguanide compound is phenylbiguanide.

36. The coating composition of claim 34, wherein the aryl biguanide compound is an alkylphenyl biguanide compound.

37. The coating composition of claim 36, wherein the alkylphenyl biguanide compound comprises a phenyl ring having at least one $C_1$–$C_6$ alkyl group as a substituent.

38. The coating composition of claim 36, wherein the alkylphenyl biguanide compound is 1-(o-tolyl)biguanide.

39. The coating composition of claim 32, wherein the binder comprises a hydroxylic polymer.

40. The coating composition of claim 32, wherein the binder comprises polyvinyl butyral.

41. The coating composition of claim 32, wherein the binder comprises a styrene/allyl alcohol copolymer.

42. The coating composition of claim 32, wherein the particulate material comprises poly(methyl methacrylate) beads.

43. An imaging system for thermal transfer imaging, comprising:

a color-bearing element comprising a colorant and an infrared-absorbing dye; and a bleaching element comprising a sheet support having an imaging side and a coating disposed on the imaging side, the coating comprising a polymeric binder and a biguanide bleaching agent;

wherein the biguanide bleaching agent is capable of bleaching the infrared-absorbing dye when the biguanide bleaching agent and the infrared-absorbing dye are in contact.

44. The imaging system of claim 43, wherein the color-bearing element is a donor element having a transferable colorant.

45. The imaging system of claim 44, wherein the sheet support of the proof substrate is paper or card stock.

46. The imaging system of claim 43, wherein the bleaching element is a proof substrate.

47. The imaging system of claim 43, wherein the bleaching element includes a transferable coating comprising the biguanide bleaching agent.

48. A method for use in the production of an integral proof, comprising:

providing a color-bearing element comprising a transferable colorant and an infrared-absorbing dye;

providing a bleaching element comprising a sheet support having an image-receiving side and a coating on the image-receiving side, the coating comprising a polymeric binder and a biguanide bleaching agent;

assembling the color-bearing element and the bleaching element in close proximity, with the image-receiving side of the bleaching element adjacent to the color-bearing element; and imagewise transferring colorant from the color-bearing element to the image-receiving side of the bleaching element.

49. The method of claim 48, wherein the color-bearing element is a donor element, and the bleaching element is a receptor element.

50. The method of claim 48 wherein the step of imagewise transferring colorant comprises:

imagewise exposing the assembly of the donor and receptor elements using infrared radiation, to cause imagewise transfer of colorant from the donor element to the receptor element.

51. The method of claim 50 wherein an infrared laser is used for imagewise exposure.

52. The method of claim 50 further comprising:

providing a second donor element comprising a second transferable colorant and an second infrared-absorbing dye;

assembling the second donor element and the receptor element in close proximity, with the image-receiving side of the receptor sheet support adjacent to the second donor element;

imagewise exposing in register the assembly of the second donor and receptor elements using infrared radiation, to cause imagewise transfer of colorant from the second donor element to the receptor element; and imagewise transferring colorant from the receptor element to a proof substrate.

53. The method of claim 52, further comprising:

providing a third donor element comprising a third transferable colorant and a third infrared-absorbing dye;

assembling the third donor element and the receptor element in close proximity, with the image-receiving side of the receptor sheet support adjacent to the third donor element; and imagewise exposing in register the assembly of the third donor and receptor elements using infrared radiation, to cause imagewise transfer of colorant from the third donor element to the receptor element.

54. The method of claim 48, wherein the color-bearing element is an image-bearing element, and the step of imagewise transferring colorant comprises transferring colorant under action of pressure or overall heating of the assembly of the color-bearing and bleaching elements.

55. The method of claim 54, wherein the bleaching element is a proof substrate.

56. The method of claim 55, wherein the sheet support is paper or card stock.

57. The method of claim 48, wherein a portion of the infrared-absorbing dye is transferred to the image-receiving side of the bleaching element during imagewise transfer of colorant, and wherein the biguanide bleaching agent bleaches the transferred infrared-absorbing dye.

* * * * *

UNITED STATES PATENT AND TRADEMARK OFFICE

CERTIFICATE OF CORRECTION

PATENT NO. : 7,172,992 B2
APPLICATION NO. : 10/949899
DATED : February 6, 2007
INVENTOR(S) : Kevin M. Kidnie et al.

It is certified that error appears in the above-identified patent and that said Letters Patent is hereby corrected as shown below:

| | |
|---|---|
| First Page, Col. 1, Line 2 (Inventors) | After "R." insert -- Jr. --. |
| Column 31, Line 10 | In Claim 22, delete "1-o-tolyl)" and insert -- 1-(o-tolyl) -- |
| Column 31, Line 67 | In Claim 33, delete "from." and insert -- form. -- |

Signed and Sealed this

Thirteenth Day of May, 2008

JON W. DUDAS
*Director of the United States Patent and Trademark Office*